US009739036B2

(12) United States Patent
Lee et al.

(10) Patent No.: US 9,739,036 B2
(45) Date of Patent: Aug. 22, 2017

(54) AUTOMATIC CONTROL SYSTEM AND METHOD FOR JOYSTICK CONTROL-BASED CONSTRUCTION EQUIPMENT

(71) Applicant: HYUNDAI HEAVY INDUSTRIES CO., LTD., Dong-gu (KR)

(72) Inventors: Jong Chan Lee, Seongnam-si (KR); Lim Gook Choi, Busan (KR); Young Min Kwon, Yongin-si (KR); Jong Hyung Yim, Yongin-si (KR)

(73) Assignee: Hyundai Construction Equipment Co., Ltd., Seoul (KR)

( * ) Notice: Subject to any disclaimer, the term of this patent is extended or adjusted under 35 U.S.C. 154(b) by 0 days.

(21) Appl. No.: 14/651,220

(22) PCT Filed: Nov. 20, 2013

(86) PCT No.: PCT/KR2013/010578
§ 371 (c)(1),
(2) Date: Jun. 10, 2015

(87) PCT Pub. No.: WO2014/092355
PCT Pub. Date: Jun. 19, 2014

(65) Prior Publication Data

US 2015/0308078 A1 Oct. 29, 2015

(30) Foreign Application Priority Data

Dec. 13, 2012 (KR) ..... 10-2012-0145613
Nov. 12, 2013 (KR) ..... 10-2013-0136863

(51) Int. Cl.
*F15B 15/00* (2006.01)
*E02F 9/20* (2006.01)
(Continued)

(52) U.S. Cl.
CPC ..... *E02F 9/2025* (2013.01); *E02F 3/42* (2013.01); *E02F 3/434* (2013.01); *E02F 3/437* (2013.01);
(Continued)

(58) Field of Classification Search
USPC ..... 701/50; 74/469, 47 R, 491
See application file for complete search history.

(56) References Cited

U.S. PATENT DOCUMENTS 5,359,517 A 10/1994 Moriya et al.
5,692,541 A * 12/1997 Brown ..... F15B 13/0422 137/636.1
(Continued)

FOREIGN PATENT DOCUMENTS

CN 102041824 5/2011
CN 202273264 6/2012
(Continued)

OTHER PUBLICATIONS

Extended European Search Report dated Jul. 26, 2016 for European Patent Application No. 13862042.2.
(Continued)

*Primary Examiner* — Richard Goldman
(74) *Attorney, Agent, or Firm* — Ladas & Parry, LLP

(57) ABSTRACT

According to the present invention, a hydraulic system of construction equipment is implemented as a close center system, which converts an input signal of an electric or hydraulic joystick into a speed signal of a work apparatus, and controls a speed of the work apparatus regardless of an external load condition, thereby minimizing fatigue of a worker to improve work efficiency, improving a work apparatus operation ability of an unskilled person, and patterning standardized work to implement automation of construction equipment.

12 Claims, 6 Drawing Sheets

(51) Int. Cl.

| | |
|---|---|
| ***E02F 9/22*** | (2006.01) |
| ***F15B 11/00*** | (2006.01) |
| ***E02F 3/42*** | (2006.01) |
| ***F15B 11/16*** | (2006.01) |
| ***F15B 13/08*** | (2006.01) |
| ***F15B 21/02*** | (2006.01) |
| ***E02F 3/43*** | (2006.01) |
| ***E02F 9/26*** | (2006.01) |

(52) U.S. Cl.

CPC ..... *E02F 9/2004* (2013.01); *E02F 9/2203* (2013.01); *E02F 9/2228* (2013.01); *E02F 9/2267* (2013.01); *E02F 9/2289* (2013.01); *E02F 9/2296* (2013.01); *E02F 9/265* (2013.01); *F15B 11/006* (2013.01); *F15B 11/161* (2013.01); *F15B 13/085* (2013.01); *F15B 13/086* (2013.01); *F15B 21/02* (2013.01); *F15B 2211/20546* (2013.01); *F15B 2211/30575* (2013.01); *F15B 2211/327* (2013.01); *F15B 2211/6346* (2013.01); *F15B 2211/75* (2013.01)

(56) References Cited

U.S. PATENT DOCUMENTS

| | | | | |
|---|---|---|---|---|
| 6,064,933 | A | 5/2000 | Rocke | |
| 6,430,490 | B1 * | 8/2002 | Watanabe | E02F 9/2203 180/53.4 |
| 2007/0012038 | A1 * | 1/2007 | Bitter | B66F 9/0655 60/413 |
| 2007/0044465 | A1 | 3/2007 | Zhang et al. | |
| 2011/0017310 | A1 * | 1/2011 | Eriksson | E02F 9/2203 137/14 |
| 2013/0001449 | A1 * | 1/2013 | Choi | B66C 13/56 251/129.03 |
| 2013/0152573 | A1 * | 6/2013 | Tsuruga | E02F 9/2075 60/420 |
| 2013/0213031 | A1 * | 8/2013 | Ok | E02F 3/436 60/486 |
| 2013/0312403 | A1 * | 11/2013 | Lim | E02F 9/2235 60/462 |
| 2015/0354174 | A1 * | 12/2015 | Lee | E02F 9/2253 701/50 |
| 2015/0361641 | A1 * | 12/2015 | Urbanowicz | E02F 9/2207 414/687 |

FOREIGN PATENT DOCUMENTS

| | | |
|---|---|---|
| EP | 1 403 526 | 3/2004 |
| JP | 1-223225 | 9/1989 |
| JP | 9-328786 | 12/1997 |
| JP | 2000-54437 | 2/2000 |
| JP | 2004-270924 | 9/2004 |
| JP | 2006-242110 | 9/2006 |
| KR | 10-0651695 | 11/2006 |
| KR | 10-2009-0059180 | 6/2009 |
| KR | 10-2011-0139344 | 12/2011 |
| KR | 10-2012-0003173 | 1/2012 |
| KR | 10-1128639 | 3/2012 |

OTHER PUBLICATIONS

International Search Report mailed Mar. 13, 2014 for International Application No. PCT/KR2013/010578.

Office Action dated May 30, 2016 for Chinese Patent Application No. 201380071365.7 and its machine translation provided by Google Translate.

International Preliminary Report on Patentability (Chapter I) for PCT/KR2013/010578 dated on Jun. 16, 2015 and its machine translation provided by Google Translate.

Written Opinion of the International Searching Authority for PCT/KR2013/010578 dated on Mar. 13, 2014 and its English translation provided by WIPO.

Office Action dated Jun. 2, 2017 for Korean Patent Application No. 10-2012-0145613 and its machine translation by Global Dossier.

* cited by examiner

AUTOMATIC CONTROL SYSTEM AND METHOD FOR JOYSTICK CONTROL-BASED CONSTRUCTION EQUIPMENT

CROSS-REFERENCE TO RELATED APPLICATION(S)

This application is the U.S. National Stage of International Patent Application No. PCT/KR2013/010578 filed on Nov. 20, 2013, which claims priority to Korean Patent Application Nos. 10-2012-0145613 filed on Dec. 13, 2012 and 10-2013-0136863 filed Nov. 12, 2013, the disclosures of which are hereby incorporated in their entireties by reference.

TECHNICAL FIELD

The present invention relates to a system for automatically controlling construction equipment, and particularly, to a system for automatically controlling construction equipment based on a joystick control, which is capable of variably controlling an area of a flow path by installing an electronic hydraulic control valve in each flow path necessary for controlling an actuator, and automatically controlling the electronic hydraulic control valve by converting an input signal of a joystick into a speed signal of a construction work apparatus.

BACKGROUND ART

In general, construction equipment is utilized for various uses, such as excavation or transfer of heavy things in a construction field and an industrial field, and is generally divided into wheel construction equipment and caterpillar construction equipment according to a travel scheme.

Here, the construction equipment generally refers to an excavator, a wheel loader, a forklift truck, a back hoe, and the like, and includes an engine, a hydraulic pump generating hydraulic pressure by using power of the engine, a control unit controlling the hydraulic pressure generated by the hydraulic pump by using a hydraulic valve, and an actuator operated by the controlled hydraulic pressure.

Particularly, the construction equipment operates each actuator, for example, the actuator operates a boom, an arm, and a bucket, according to the control of a flow rate and a hydraulic pressure, to perform predetermined work.

Here, as technology for controlling a flow rate and a hydraulic pressure, an open-center flow control system and a load sensing hydraulic system have been known.

The open-center flow control system has a negative flow control scheme, in which a pressure generated at a front end of an orifice is applied to a flow control unit by a flow rate passing through a center bypass and flowing into a tank to control a swash plate angle of a pump, and a positive flow control scheme, in which a pilot pressure of a joystick is selected and applied to a flow control unit to control a swash plate angle of a pump, and the aforementioned two control schemes are configurations in which a discharge flow rate of the pump is divided into a center bypass flow path and an actuator flow path at a part, at which a worker performs a precise operation.

On the other hand, it is known that in the load sensing hydraulic system, an excessive flow rate is not generated, and a flow rate may be distributed regardless of a load of the actuator through a pressure compensator.

The aforementioned technology of controlling a hydraulic pressure and a flow rate is mechanically implemented, so that there is a problem in that a degree of freedom of a control is limited, and it is necessary to always excessively operate the pump and the engine operated in response to an operation of the actuator, so that fuel efficiency is degraded.

In the meantime, the construction equipment is generally used in various work conditions as described above, so that an engine in accordance with a work condition and a means for setting an output of a hydraulic pump need to be included.

That is, pre-stored target revolutions per minute (RPM) of the engine, an RPM of the engine according to an input torque of the hydraulic pump, and an input torque of the hydraulic pump are set according to each work environment.

Accordingly, since an engine throttle lever always maintains a predetermined value regardless of a work speed of a worker or a load degree, fuel is unnecessarily consumed and noise and vibration are generated.

In order to solve the problem, a method of setting a low RPM of an engine in no-load, detecting a load of the engine by a load detecting means, and outputting an RPM of the engine in accordance with the load of the engine has been suggested.

An excavator in the related art uses an open center scheme or a load sensing scheme, and a means for variably controlling an engine and the like, and in this case, in order to automatically control a work apparatus of the excavator, the excavator uses a method of attaching an angle sensor to a connection portion of the work apparatus, and storing information of each angle sensor of a work section, which a worker instructs to store, and reproducing the stored information, or a method of storing a work trace by using a stroke sensor and implementing and correcting the stored work trace.

However, the aforementioned method is influenced by a work environment, such as a characteristic of equipment including each actuator or an angle sensor, a road state, and a load, so that a reproduction property is degraded, and thus an original function is easily lost.

DISCLOSURE

Technical Problem

The present is conceived to solve the aforementioned problem, and an object of the present invention provides a system and a method of automatically controlling construction equipment based on a joystick control, which implement a hydraulic system of construction equipment as a close center system using an electric or hydraulic joystick and an electronic proportional control valve, convert an input signal of the electric or hydraulic joystick into a speed signal of a work apparatus, and control a speed of the work apparatus regardless of an external load condition.

Another object of the present invention provide a system for automatically controlling construction equipment based on a joystick control, which is capable of variably controlling an electronic hydraulic system by an independent flow control method by installing an electronic hydraulic control valve in each flow path connected to an actuator to achieve an excellent reproduction property and provide an automatic control function and a teach & play back function.

Technical Solution

An exemplary embodiment of the present invention provides a system for automatically controlling construction equipment, to which a joystick is applied, based on a joystick control, including: a hydraulic pump configured to discharge working fluid within a hydraulic tank and supply the working fluid to an actuator; the actuator configured to drive the construction work apparatus with the working fluid of the hydraulic pump; first electronic hydraulic control valves installed in a piston-side inlet flow path and a rod-side inlet flow path connected from the hydraulic pump to the actuator; second electronic hydraulic control valves installed in a piston-side outlet flow path and a rod-side outlet flow path connected from the actuator to the hydraulic tank; and a control unit configured to independently control the first electronic hydraulic control valves and the second electronic hydraulic control valves connected to the actuator.

The joystick may be an electric joystick, and when an electric signal is generated by an operation of the electric joystick, the control unit may control the first electronic hydraulic control valves and the second electronic hydraulic control valves connected to the actuator by using the electric signal generated by the operation of the electric joystick.

The joystick may be a hydraulic joystick, and the system may further include a pressure sensor converting a pilot pressure formed by an operation of the hydraulic joystick into an electric signal, and the control unit may control the first electronic hydraulic control valves and the second electronic hydraulic control valves connected to the actuator by using an electric signal generated by the pressure sensor.

The control unit may further include a controller converting a coded electric signal, which is in proportion to a stroke, by an operation of the electric joystick or the hydraulic joystick into a speed signal, so that an open/close of the first electronic hydraulic control valves and the second electronic hydraulic control valves may be controlled, and a work speed of the construction work apparatus may be changed.

An area of the flow path may be variably controlled by the first electronic hydraulic control valves and the second electronic hydraulic control valves according to an operation quantity of the electric joystick or the hydraulic joystick.

The control unit may further include a storage unit storing an electric signal and a speed signal generated according to an operation of the electric joystick or the hydraulic joystick in real time, and a monitoring unit monitoring an electric signal and a speed signal generated according to an operation of the electric joystick or the hydraulic joystick in real time.

Another exemplary embodiment of the present invention provides a method of automatically controlling construction equipment based on a joystick control, including: converting a signal generated by an operation of a joystick lever of a construction work apparatus into an electric signal, and inputting the electric signal; converting the electric signal of the joystick lever into a speed signal of the construction work apparatus; selecting an automatic excavation function of the construction work apparatus; storing an operation signal of the joystick lever; performing automatic excavation (teach & play back) by the construction work apparatus; generating control signals of a pump and an electronic hydraulic valve according to the pre-stored operation signal of the joystick lever; and driving actuators of the construction work apparatus.

The joystick may be any one of an electric joystick and a hydraulic joystick.

The method may further include generating control signals of a pump and an electronic hydraulic valve according to a lever signal of the electric joystick or the hydraulic joystick when the automatic excavation function of the construction work apparatus is not selected.

A button or a kind of switch may be further provided at the electric joystick or the hydraulic joystick, or a separate predetermined operation button or kind of switch is further provided so as to select the automatic excavation function, so that an automatic excavation performance selection signal may be input into a control unit.

When the automatic excavation of the construction work apparatus is not performed, the method may return to the operation of selecting the automatic excavation function of the construction work apparatus.

Advantageous Effects

According to the present invention, a hydraulic system of construction equipment is implemented as a close center system, which converts an input signal of an electric or hydraulic joystick into a speed signal of a work apparatus, and a speed of the work apparatus is controlled regardless of an external load condition, thereby minimizing fatigue of a worker to improve work efficiency, improving a work apparatus operation ability of an unskilled person, and patterning standardized work to implement automation of construction equipment.

Further, the present invention may more precisely control a flow rate according to an operation quantity of the electric or hydraulic joystick, thereby optimally decreasing an operation time of the engine and the hydraulic pump, and thus it is possible to independently control a flow path and a flow rate, thereby remarkably improving a degree of freedom of a flow control of heavy construction equipment. Further, through the improvement of a degree of freedom of a flow control of heavy construction equipment, it is possible to minimize fatigue of a worker, improve fuel efficiency, and improve safety and work efficiency of a worker.

Further, the present invention stores an input signal of a worker driving a work apparatus to be operated at a speed corresponding to a signal of a stored section when controlling a plurality of actuators. Accordingly, it is possible to implement an automatic control operation without separate measurement equipment and a feedback function.

Further, the present invention stores a speed corresponding to a signal of a stored section and a start time point of the signal of the stored section, so that even though the present invention is exposed to a different condition from a stored work condition due to a change in an equipment, environment, or load condition, the speed is estimated based on the stored speed of the work apparatus to implement automatic control work, thereby stably performing work reproduction regardless of an external condition.

DESCRIPTION OF DRAWINGS

The accompanying drawings in the present specification are for illustrating an exemplary embodiment of the present invention, and more fully understanding the technical spirit of the present invention together with the detailed description of the invention, so that the present invention shall not be construed while being limited to the matters described in the drawings.

BEST MODE

Hereinafter, exemplary embodiments of a system and a method of automatically controlling construction equipment based on a joystick control according to the present invention will be described in detail.

Figure 1:
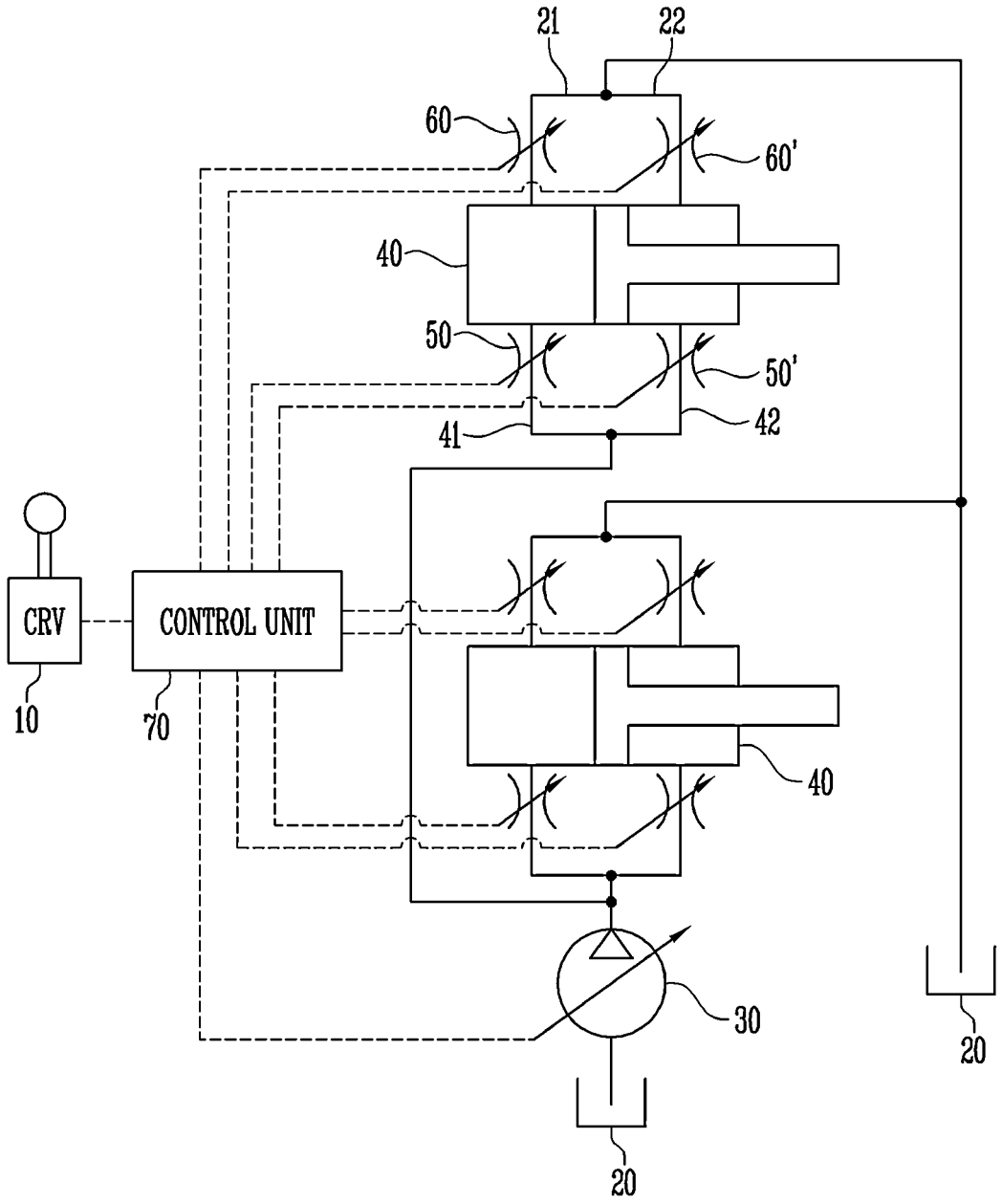
FIGS. 1 and 2 are conceptual diagram illustrating a general configuration of a system for automatically controlling construction equipment based on a electric joystick control according to a first exemplary embodiment of the present invention.
Figure 2:
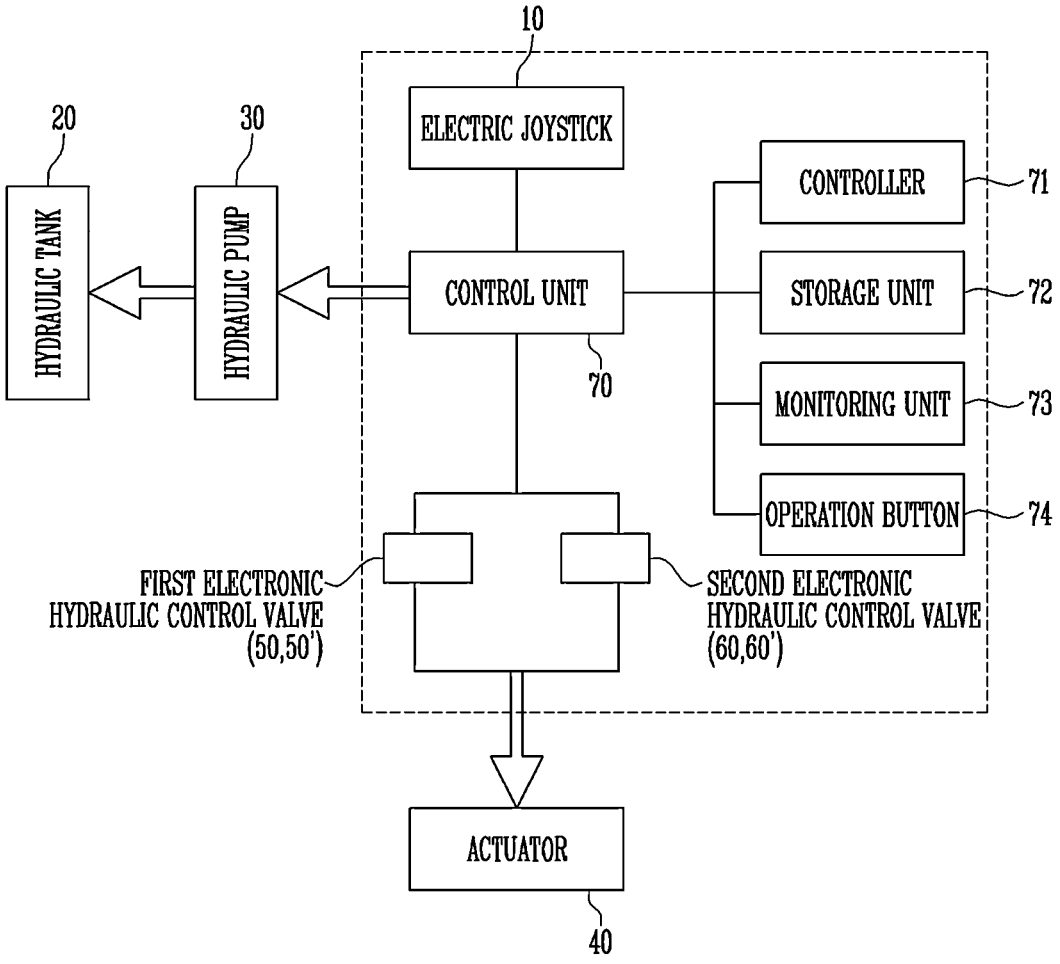

FIGS. 1 and 2 are conceptual diagram illustrating a general configuration of a system for automatically controlling construction equipment based on a electric joystick control according to a first exemplary embodiment of the present invention.

Referring to FIGS. 1 and 2, a system for automatically controlling construction equipment based on a electric joystick control according to a first exemplary embodiment of the present invention includes an electric joystick 10, a hydraulic tank 20, a hydraulic pump 30, actuators 40, first electronic flow rate control valves 50 and 50', second electronic flow rate control valves 60 and 60', and a control unit 70, which will be described in detail below.

The electric joystick 10 is an operation tool of a construction work apparatus, and when a worker operates the electric joystick 10 for work, such as lift or tilt, a coded electric signal, which is in proportion to a stroke, is output.

The hydraulic pump 30 discharges working fluid within the hydraulic pump 30 driven by an engine, and supplies working fluid to the plurality of actuators 40, and the discharge flow rate of the hydraulic pump 30 is controlled by the control unit 70.

The actuator 40, which drives various construction work apparatuses, is connected with the hydraulic pump 30 by a piston-side inlet flow path 41 and a rod-side inlet flow path 42, and is connected to the hydraulic tank 20 by a piston-side outlet flow path 21 and a rod-side outlet flow path 22, and the number of actuators 40 provided is plural.

The first electronic hydraulic control valves 50 and 50' are installed at the piston-side inlet flow path 41 and the rod-side inlet flow path 42, respectively, and the second electronic hydraulic control valves 60 and 60' are installed at the piston-side outlet flow path 21 and the rod-side outlet flow path 22, respectively.

The first electronic hydraulic control valves 50 and 50' and the second electronic hydraulic control valves 60 and 60' are installed in every flow path connected to each actuator 40, and are connected with the control unit 70 to be controlled by an operation quantity of the electric joystick 10.

The control unit 70 is connected with the electric joystick 10, so that information on an operation quantity of the electric joystick 10 is stored in a storage unit 72, and controls the first electronic hydraulic control valve 50, the second electronic hydraulic control valve 60, and the pressure control-scheme hydraulic pump 30 by a pre-stored algorithm based on the information on the operation quantity pre-stored in the storage unit 72 to control a speed of the actuator 40.

In this case, the control unit 70 includes a controller 71, the storage unit 72, and a monitoring unit 73.

The controller 71 converts a coded electric signal, which is in proportion to a stroke, into a speed signal by an operation of the electric joystick 10 to close open and close of the first electronic hydraulic control valves 50 and 50' and the second electronic hydraulic control valves 60 and 60', thereby enabling change of a work speed of the construction work apparatus.

Further, the storage unit 72 stores an electric signal and a speed signal generated according to an operation of the electric joystick 10 in a real time.

The monitoring unit 73 monitors an electric signal and a speed signal generated according to an operation of the electric joystick 10 in a real time.

That is, the present invention implements a close center system, in which each actuator 40 is subjected to an individual flow rate control controlled by an electronic hydraulic control valve, a predetermined flow rate is not discharged from the hydraulic pump 30 when the electric joystick 10 is in a neutral stage, and there is no bypass flow path.

In the present invention, when a worker operates the electric joystick 10, the number of simultaneously driven actuators 40 and the information on the operation quantity of the electric joystick 10 are stored in the storage unit 72, a speed of each actuator 40 is determined according to the algorithm pre-stored in the storage unit 72, and the first electronic hydraulic control valves 50 and 50', the second electronic hydraulic control valves 60 and 60', and the hydraulic pump 30 are controlled by the control unit 70, so that an area of a variable orifice and a difference in a pressure between a front end and a rear end of the variable orifice governing a movement of the actuator 40 are controlled, thereby implementing a target speed of the actuator 40 according to an intention of an operator.

Accordingly, the present invention may randomly store a specific repeated operation, such as auto levelling and excavation, by using the aforementioned characteristic, and uniformly control a speed of the construction work apparatus even in a change in a load condition, and pattern a standardized operation and re-implement the operation, thereby implementing a teach & play back system by automation.

Figure 3:
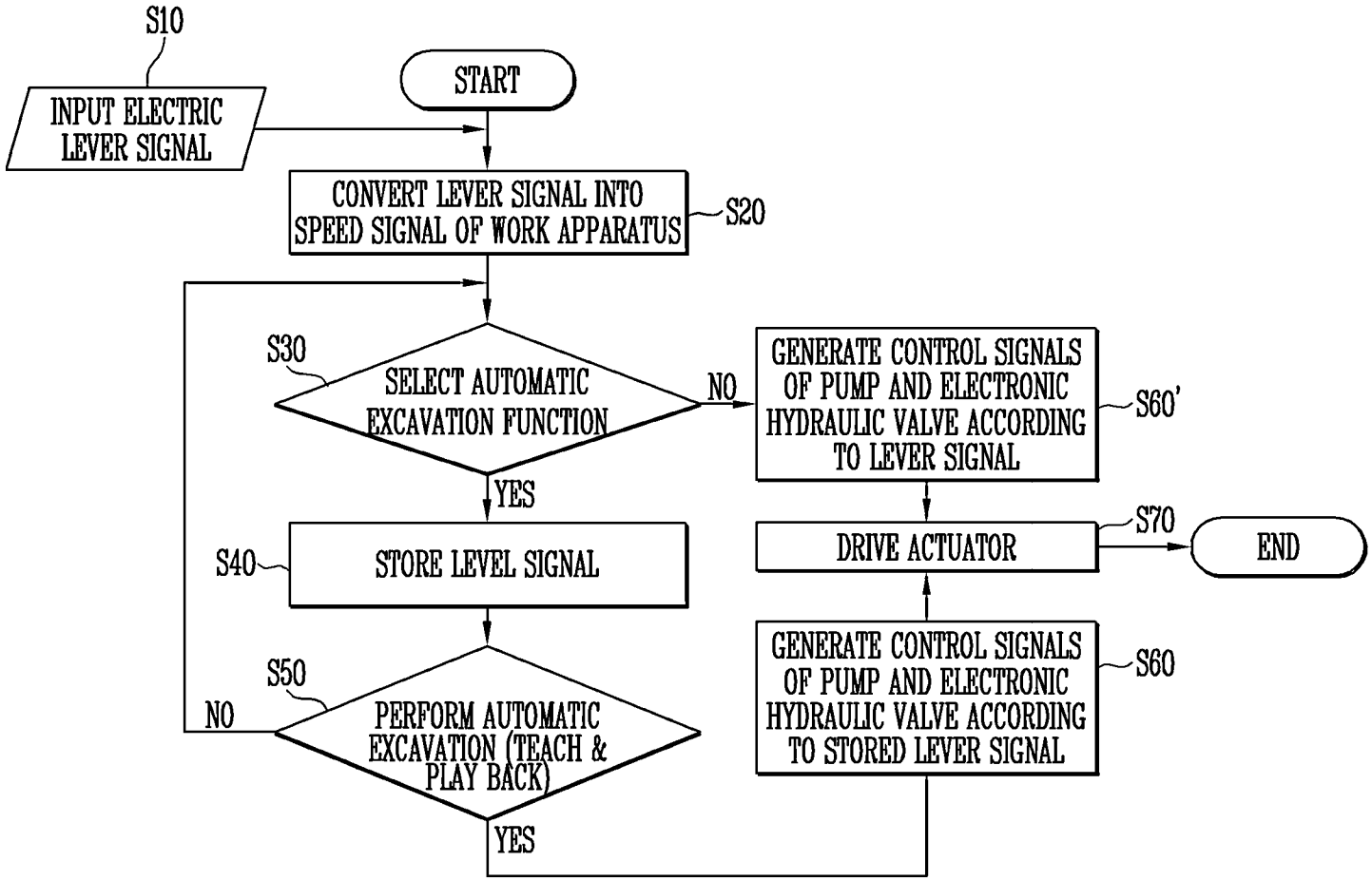
FIG. 3 is a conceptual diagram schematically illustrating an algorithm of a method of automatically controlling construction equipment based on a electric joystick control according to the first exemplary embodiment of the present invention.

FIG. 3 is a conceptual diagram schematically illustrating an algorithm of a method of automatically controlling construction equipment based on a electric joystick control according to the first exemplary embodiment of the present invention.

Referring to FIG. 3, in a method of automatically controlling construction equipment based on a electric joystick control according to the first exemplary embodiment of the present invention, a worker first inputs an electric signal into an electric joystick lever of a construction work apparatus (operation S10).

Next, the lever signal of the joystick operated by the worker is converted into a speed signal of the construction work apparatus (operation S20).

Next, an automatic excavation function of the construction work apparatus is selected by the lever signal of the joystick, which has been converted into the speed signal of the construction work apparatus (operation S30).

In this case, a button or a kind of switch, or a separate predetermined operation button 74 or kind of switch is further provided at the electric joystick 10 so as to select the automatic excavation function, so that an automatic excavation performance selection signal is input into the control unit 70 (see FIG. 2).

The operation button 74 may be input through a monitoring unit, input by a switch mounted in a separate console, and input by a switch mounted in the electric joystick.

Next, when the automatic excavation function of the construction work apparatus is selected, an operation signal of the electric joystick lever is stored (operation S40).

In this case, when the automatic excavation function of the construction work apparatus is not selected, control signals of a pump and an electronic hydraulic valve are generated according to the lever signal of the electric joystick (operation S60"), so that the actuators are driven.

In the meantime, when the operation signal of the electric joystick lever is stored, the construction work apparatus automatically performs excavation (operation S50).

Next, when the construction work apparatus automatically performs the excavation, control signals of a pump and an electronic hydraulic valve are generated according to the pre-stored lever signal of the electric joystick (operation S60).

Last, when the control signals of the pump and the electronic hydraulic valve are generated according to the lever signal of the electric joystick, the actuators are finally driven (operation S70).

Here, when the automatic excavation of the construction work apparatus is not performed, the method returns to the operation of selecting the automatic excavation function of the construction work apparatus.

That is, the method of automatically controlling construction equipment based on a joystick control according to the first exemplary embodiment of the present invention implements the teach & play back function, which is capable of converting an operation quantity of the electric joystick into a speed of the construction work apparatus, selecting to store the speed of the construction work apparatus as data, reproducing the stored speed signal of the construction work apparatus according to a selection switch, and repeatedly and automatically controlling the construction work apparatus.

Figure 4:
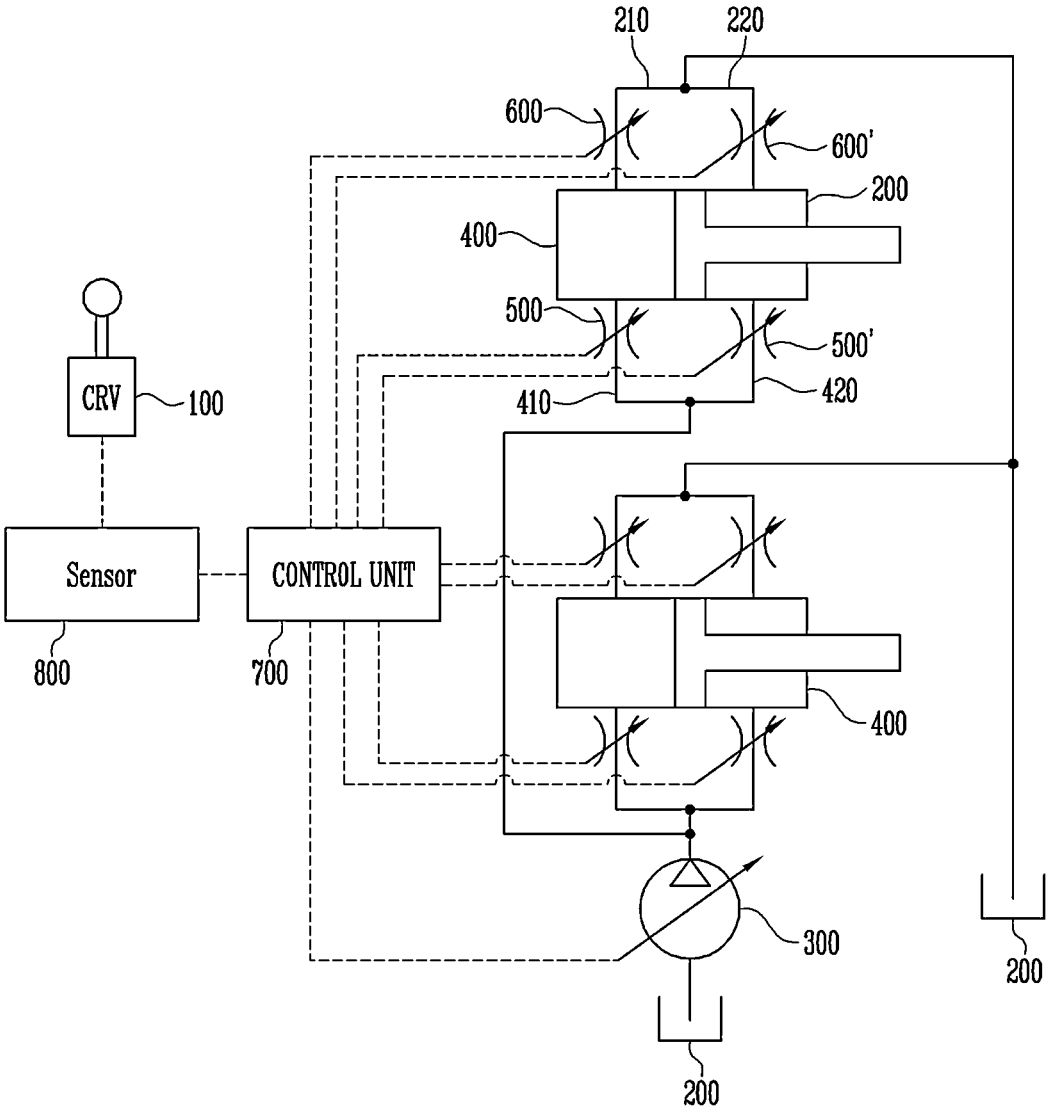
FIGS. 4 and 5 are conceptual diagram illustrating a general configuration of a system for automatically controlling construction equipment based on a hydraulic joystick control according to a second exemplary embodiment of the present invention.
Figure 5:
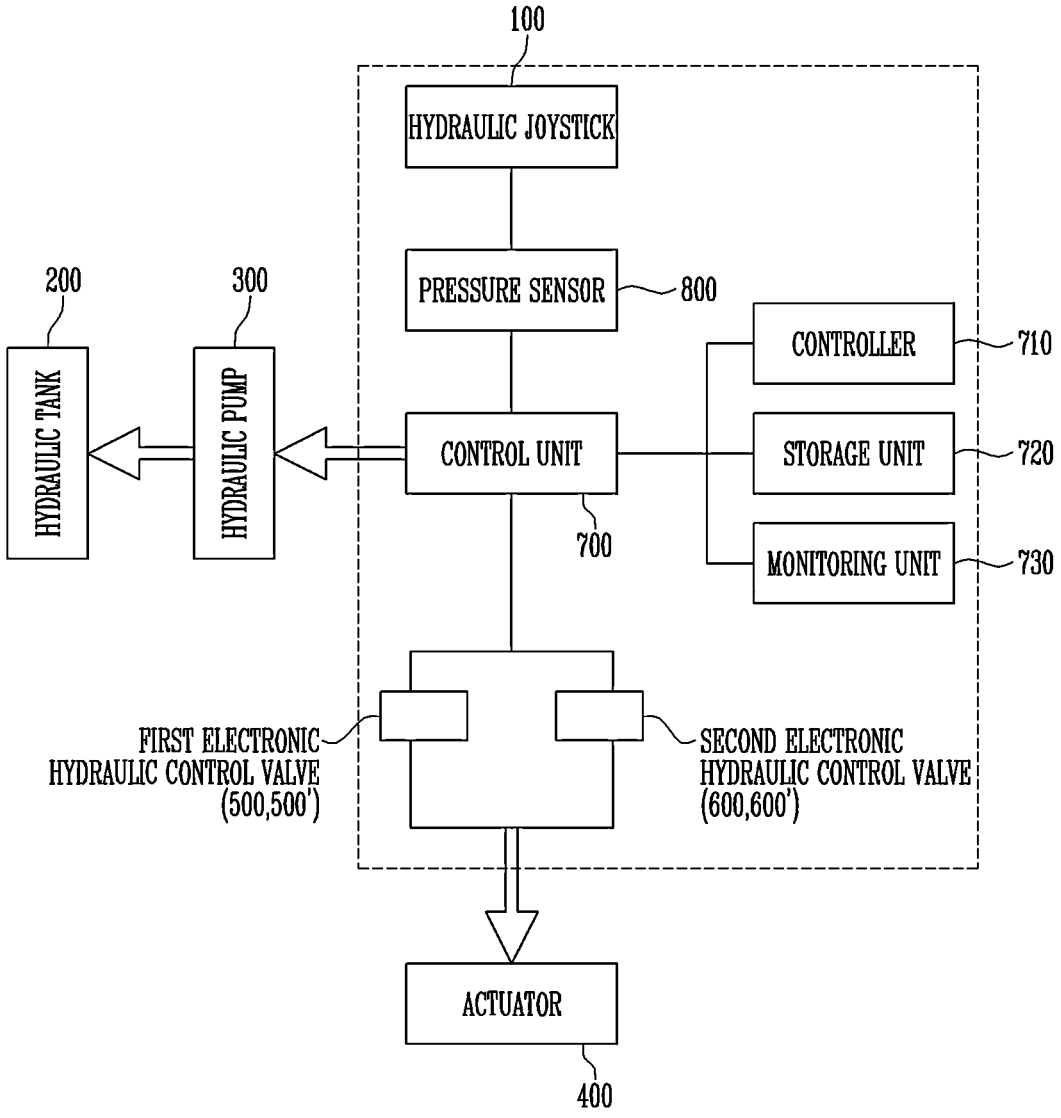

FIGS. 4 and 5 are conceptual diagram illustrating a general configuration of a system for automatically controlling construction equipment based on a hydraulic joystick control according to a second exemplary embodiment of the present invention.

Referring to FIGS. 4 and 5, a system for automatically controlling construction equipment based on a hydraulic joystick control according to a second exemplary embodiment of the present invention includes a hydraulic joystick 100, a hydraulic tank 200, a hydraulic pump 300, actuators 400, first electronic flow rate control valves 500 and 500', second electronic flow rate control valves 600 and 600', and a control unit 700, which will be described in detail below.

The hydraulic joystick 100 is an operation tool of a construction work apparatus, and when a worker operates the hydraulic joystick 10 for work, such as lift or tilt, a pilot pressure signal, which is in proportion to a stroke, is output.

The hydraulic pump 300 discharges working fluid within the hydraulic pump 300 driven by an engine, and supplies working fluid to the plurality of actuators 400, and the discharge flow rate of the hydraulic pump 300 is controlled by the control unit 700.

The actuator 400, which drives various construction work apparatuses, is connected with the hydraulic pump 300 by a piston-side inlet flow path 410 and a rod-side inlet flow path 420, and is connected to the hydraulic tank 200 by a piston-side outlet flow path 210 and a rod-side outlet flow path 220, and the number of actuators 400 provided is plural.

The first electronic hydraulic control valves 500 and 500' are installed at the piston-side inlet flow path 410 and the rod-side inlet flow path 420, respectively, and the second electronic hydraulic control valves 600 and 600' are installed at the piston-side outlet flow path 210 and the rod-side outlet flow path 220.

The first electronic hydraulic control valves 500 and 500' and the second electronic hydraulic control valves 600 and 600' are installed in every flow path connected to each actuator 400, and are connected with the control unit 700 to be controlled by an operation quantity of the hydraulic joystick 100.

The control unit 700 is connected with the hydraulic joystick 100, so that information on an operation quantity of the hydraulic joystick 100 is stored in a storage unit 720, and controls the first electronic hydraulic control valve 500, the second electronic hydraulic control valve 600, and the pressure control-scheme hydraulic pump 300 by a pre-stored algorithm based on the information on the operation quantity pre-stored in the storage unit 720 to control a speed of the actuator 400.

In this case, the control unit 700 includes a controller 710, the storage unit 720, and a monitoring unit 730.

The pilot pressure signal, which is in proportion to the stroke, is output by the operation of the hydraulic joystick 100, and the controller 710 changes the pressure value to an electric signal by using a pressure sensor 800.

The controller 710 converts the value, which is changed to the electric signal, into a speed signal to control the open/close of the first electronic hydraulic control valve 500 and 500' and the second electronic hydraulic control valve 600 and 600', thereby changing a work speed of the construction work apparatus.

Further, the storage unit 720 stores an electric signal and a speed signal generated according to an operation of the hydraulic joystick 100 in a real time.

The monitoring unit 730 monitors an electric signal and a speed signal generated according to an operation of the hydraulic joystick 10 in a real time.

That is, the present invention implements a close center system, in which each actuator 400 is subjected to an individual flow rate control controlled by an electronic hydraulic control valve, a predetermined flow rate is not discharged from the hydraulic pump 300 when the hydraulic joystick 100 is in a neutral stage, and there is no bypass flow path.

In the present invention, when a worker operates the hydraulic joystick 100, the number of simultaneously driven actuators 400 and the information on the operation quantity of the hydraulic joystick 100 are stored in the storage unit 720, a speed of each actuator 400 is determined according to the algorithm pre-stored in the storage unit 720, and the first electronic hydraulic control valves 500 and 500', the second electronic hydraulic control valves 600 and 600', and the hydraulic pump 300 are controlled by the control unit 700, so that an area of a variable orifice and a difference in a pressure between a front end and a rear end of the variable orifice governing a movement of the actuator 400 are controlled, thereby implementing a target speed of the actuator 400 according to an intention of an operator.

Accordingly, the present invention may randomly store a specific repeated operation, such as auto levelling and excavation, by using the aforementioned characteristic, and uniformly control a speed of the construction work apparatus even in a change in a load condition, and pattern a standardized operation and re-implement the operation, thereby implementing a teach & play back system by automation.

Figure 6:
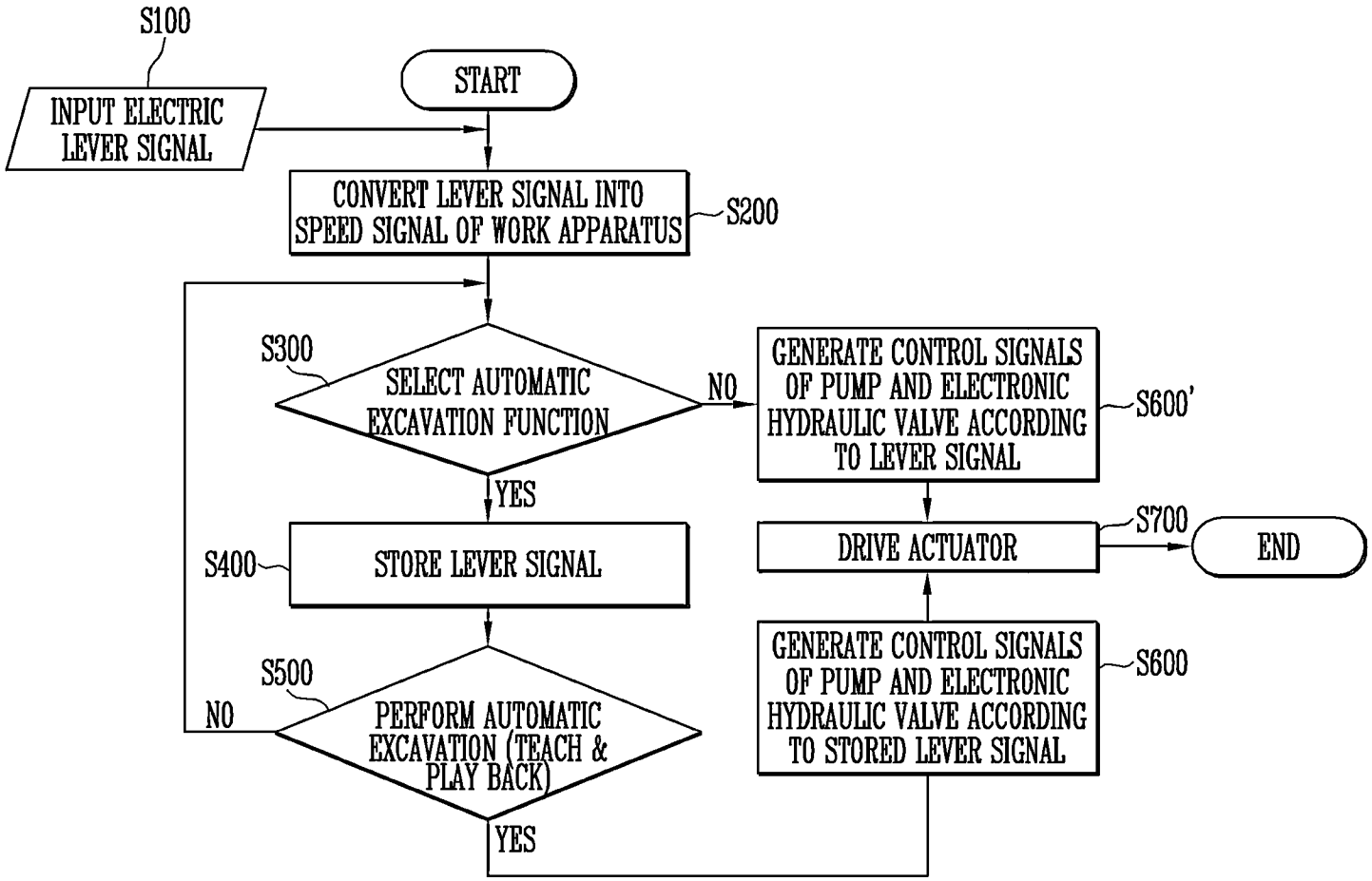
FIG. 6 is a conceptual diagram schematically illustrating an algorithm of a method of automatically controlling construction equipment based on a hydraulic joystick control according to the second exemplary embodiment of the present invention.

FIG. 6 is a conceptual diagram schematically illustrating an algorithm of a method of automatically controlling construction equipment based on a hydraulic joystick control according to the second exemplary embodiment of the present invention.

Referring to FIG. 6, in a method of automatically controlling construction equipment based on a hydraulic joystick control according to second first exemplary embodiment of the present invention, a pilot signal by an operation of the hydraulic joystick lever of a construction work apparatus is converted into an electric signal by a worker and input (operation S100).

Next, the lever signal of the joystick operated by the worker is converted into a speed signal of the construction work apparatus (operation S200).

Next, an automatic excavation function of the construction work apparatus is selected by the lever signal of the joystick, which has been converted into the speed signal of the construction work apparatus (operation S300).

In this case, a button or a kind of switch, or a separate predetermined operation button 740 or kind of switch is further provided at the hydraulic joystick 100 so as to select the automatic excavation function, so that an automatic excavation performance selection signal is input into the control unit 700 (see FIG. 5).

The operation button 740 may be input through a monitoring unit, input by a switch mounted in a separate console, and input by a switch mounted in the hydraulic joystick.

Next, when the automatic excavation function of the construction work apparatus is selected, an operation signal of the hydraulic joystick lever is stored (operation S400).

In this case, when the automatic excavation function of the construction work apparatus is not selected, control signals of the pump and the electronic hydraulic valve are generated according to the lever signal of the hydraulic joystick (operation S600'), so that the actuators are driven.

In the meantime, when the operation signal of the hydraulic joystick lever is stored, the construction work apparatus automatically performs excavation (operation S500).

Next, when the construction work apparatus automatically performs the excavation, control signals of a pump and an electronic hydraulic valve are generated according to the pre-stored lever signal of the hydraulic joystick (operation S600).

Last, when the control signals of the pump and the electronic hydraulic valve are generated according to the lever signal of the hydraulic joystick, the actuators are finally driven (operation S700).

Here, when the automatic excavation of the construction work apparatus is not performed, the method returns to the operation of selecting the automatic excavation function of the construction work apparatus.

That is, the method of automatically controlling construction equipment based on a joystick control according to the second exemplary embodiment of the present invention implements the teach & play back function, which is capable of converting an operation quantity of the hydraulic joystick into a speed of the construction work apparatus, selecting to store the speed of the construction work apparatus as data, reproducing the stored speed signal of the construction work apparatus according to a selection switch, and repeatedly and automatically controlling the construction work apparatus.

The present invention has been described based on the exemplary embodiment, but it is obvious to those skilled in the art that the technical spirit of the present invention is not limited thereto, and a modification and a change may be made within the scope of the claims, and the modification belongs to the accompanying claims.

The invention claimed is:

1. A system for automatically controlling construction equipment, to which a joystick is applied, based on a joystick control, comprising:

a hydraulic pump configured to discharge working fluid within a hydraulic tank and supply the working fluid to an actuator;

the actuator configured to drive a construction work apparatus with the working fluid of the hydraulic pump;

first electronic hydraulic control valves installed in a piston-side inlet flow path and a rod-side inlet flow path connected from the hydraulic pump to the actuator;

second electronic hydraulic control valves installed in a piston-side outlet flow path and a rod-side outlet flow path connected from the actuator to the hydraulic tank; and a control unit configured to independently control the first electronic hydraulic control valves and the second electronic hydraulic control valves connected to the actuator, wherein the system is implemented as a close center system without a bypass flow path connected from the hydraulic pump to the hydraulic tank by bypassing the actuator, the control unit determines a speed of the actuator in proportion to a stroke by an operation of the joystick and controls the first electronic hydraulic control valves, the second electronic hydraulic control values and the hydraulic pump by using the speed of the actuator regardless of an external load condition, and the control unit controls the hydraulic pump so as not to discharge a predetermined flow rate when the joystick is in a neutral stage.

2. The system of claim 1, wherein the joystick is an electric joystick, and when an electric signal is generated by an operation of the electric joystick, the control unit controls the first electronic hydraulic control valves and the second electronic hydraulic control valves connected to the actuator by using the electric signal generated by the operation of the electric joystick.

3. The system of claim 1, wherein the joystick is a hydraulic joystick, and the system further comprises a pressure sensor converting a pilot pressure formed by an operation of the hydraulic joystick into an electric signal, and the control unit controls the first electronic hydraulic control valves and the second electronic hydraulic control valves connected to the actuator by using the electric signal generated by the pressure sensor.

4. The system of claim 2, wherein the control unit further includes a controller configured to convert a coded electric signal, which is in proportion to a stroke of the electric joystick into a speed signal, to control open/close of the first electronic hydraulic control valves and the second electronic hydraulic control valves, and to change a work speed of the construction work apparatus.

5. The system of claim 4, wherein an area of a flow path is variably controlled by the first electronic hydraulic control valves and the second electronic hydraulic control valves according to an operation quantity of the electric joystick.

6. The system of claim 2, wherein the control unit further includes a storage unit storing an electric signal and a speed signal generated according to an operation of the electric joystick in real time.

7. The system of claim 3, wherein the control unit further includes a controller configured to convert a coded electric signal, which is in proportion to a stroke of the hydraulic joystick into a speed signal, to control open/close of the first electronic hydraulic control valves and the second electronic hydraulic control valves, and to change a work speed of the construction work apparatus.

8. The system of claim 3, wherein the control unit further includes a storage unit storing an electric signal and a speed signal generated according to an operation of the hydraulic joystick in real time.

9. The system of claim 7, wherein an area of a flow path is variably controlled by the first electronic hydraulic control valves and the second electronic hydraulic control valves according to an operation quantity of the hydraulic joystick.

10. The system of claim 1, wherein the control unit further comprises a storage unit configured to store the input signal generated by the operation of the joystick and the speed signal controlling the work speed of the construction work apparatus for a specific time period, wherein the control unit is configured to control the work speed of the construction work apparatus using the input signal and the speed signal previously stored in the storage unit.

11. The system of claim 1, comprising a plurality of actuators and a storage unit configured to store the number of driven actuators and information on operation quantity of the joystick, wherein the control unit is configured to control a speed of each of the actuators according to the number of driven actuators and the information on the operation quantity of the joystick stored in the storage unit.

12. The system of claim 1, wherein the control unit is configured to store an operation signal of the joystick in response to a request of automatic excavation function of the construction work apparatus and to generate control signals of the hydraulic pump and the first and second electronic hydraulic control valves by using the previously stored operation signal of the joystick.

* * * * *